US009272810B2

(12) United States Patent
Ogburn

(10) Patent No.: US 9,272,810 B2
(45) Date of Patent: Mar. 1, 2016

(54) PALLET

(75) Inventor: Sean T. Ogburn, Hoschton, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 819 days.

(21) Appl. No.: 11/843,749

(22) Filed: Aug. 23, 2007

(65) Prior Publication Data

US 2009/0050029 A1 Feb. 26, 2009

(51) Int. Cl.
*B65D 19/00* (2006.01)
*B65D 19/38* (2006.01)

(52) U.S. Cl.
CPC ..... *B65D 19/0012* (2013.01); *B65D 19/38* (2013.01); *B65D 2519/00034* (2013.01); *B65D 2519/00069* (2013.01); *B65D 2519/00273* (2013.01); *B65D 2519/00288* (2013.01); *B65D 2519/00308* (2013.01); *B65D 2519/00318* (2013.01); *B65D 2519/00333* (2013.01); *B65D 2519/00363* (2013.01); *B65D 2519/00402* (2013.01); *B65D 2519/00407* (2013.01); *B65D 2519/00562* (2013.01); *B65D 2519/00567* (2013.01)

(58) Field of Classification Search
USPC ..... 108/51.11, 56.1, 56.3, 57.25, 57.26, 108/57.33, 901
See application file for complete search history.

(56) References Cited

U.S. PATENT DOCUMENTS 3,842,565 A * 10/1974 Brown et al. ..... 52/717.05
5,445,273 A * 8/1995 Apps ..... 206/505
5,495,945 A 3/1996 Apps et al.
6,006,677 A 12/1999 Apps et al.
6,199,488 B1 * 3/2001 Favaron et al. ..... 108/57.25
6,250,234 B1 6/2001 Apps
6,283,044 B1 9/2001 Apps
6,289,823 B1 9/2001 Koefelda et al.
6,389,989 B1 * 5/2002 Hagerty ..... 108/57.25
6,389,990 B1 5/2002 Apps
6,530,476 B1 3/2003 Overholt
6,584,914 B1 7/2003 Koefelda
6,622,641 B2 9/2003 Smyers
6,644,218 B2 11/2003 Gruber
6,644,219 B2 11/2003 Apps
6,805,061 B2 10/2004 Smyers et al.
6,807,910 B2 10/2004 Apps
6,840,181 B2 1/2005 Smyers
6,849,677 B2 2/2005 Overholt
6,874,428 B2 4/2005 Apps
6,886,475 B2 5/2005 Apps et al.
6,955,128 B2 10/2005 Apps
7,086,339 B2 8/2006 Apps et al.
7,086,340 B2 8/2006 Apps
7,165,499 B2 1/2007 Apps et al.
7,197,989 B2 4/2007 Apps
7,252,041 B2 8/2007 Overholt et al.
7,293,509 B2 11/2007 Hassell (Continued)

FOREIGN PATENT DOCUMENTS

WO 2006/026783 3/2006

*Primary Examiner* — Daniel Rohrhoff
(74) *Attorney, Agent, or Firm* — Carlson, Gaskey & Olds P.C.

(57) ABSTRACT

A pallet includes an upper deck and columns extending downwardly. A portion of the upper deck protrudes outwardly relative to an outer surface of the columns. Anti-shingling protrusions are formed on the outer surface of the column below the deck in order to prevent shingling of the pallet with another pallet.

19 Claims, 3 Drawing Sheets

(56) References Cited

U.S. PATENT DOCUMENTS

| | | | | |
|---|---|---|---|---|
| 2001/0041131 | A1 | 11/2001 | Hwang et al. | |
| 2002/0017225 | A1 | 2/2002 | Koefelda et al. | |
| 2002/0043184 | A1 | 4/2002 | Apps | |
| 2004/0134390 | A1 | 7/2004 | Apps et al. | |
| 2004/0208739 | A1 | 10/2004 | Lucas et al. | |
| 2004/0216648 | A1* | 11/2004 | Apps et al. | 108/57.25 |
| 2004/0218276 | A1 | 11/2004 | Apps et al. | |
| 2004/0261669 | A1* | 12/2004 | Apps | 108/57.27 |
| 2005/0000395 | A1 | 1/2005 | Apps et al. | |
| 2005/0145145 | A1 | 7/2005 | Ogburn et al. | |
| 2005/0252424 | A1 | 11/2005 | Apps | |
| 2006/0032413 | A1 | 2/2006 | Ogburn et al. | |
| 2006/0032414 | A1 | 2/2006 | Apps | |
| 2006/0236904 | A1 | 10/2006 | Apps et al. | |
| 2006/0260976 | A1 | 11/2006 | Apps | |
| 2006/0272556 | A1 | 12/2006 | Apps | |
| 2007/0062420 | A1 | 3/2007 | Apps et al. | |
| 2008/0210140 | A1* | 9/2008 | Valentinsson | 108/57.25 |

* cited by examiner

PALLET

BACKGROUND OF THE INVENTION

The present invention relates generally to pallets. Pallets are often used to store and transport goods. The pallets maintain the goods at a distance above the floor such that they can be readily lifted and moved by a fork of a lift truck. Some pallets have stringers or double decks forming openings, which receive the forks of the lift truck. Other pallets are nestable within one another to facilitate storage and transport when empty. Both types of pallets include an upper deck supported by columns extending downwardly from the upper deck.

In some pallets, a portion of the upper deck protrudes outwardly relative to an outermost surface of the column. As a result, adjacent pallets may experience "shingling," in which the protruding part of the upper deck of one pallet catches on top of an adjacent pallet, such that the upper pallet is suspended off of the floor. This makes the stack of goods on the pallet uneven and potentially unstable.

SUMMARY OF THE INVENTION

A pallet according to one embodiment includes a deck from which a plurality of columns extend downwardly. At least a portion of the deck protrudes outwardly from and may slightly overlap a portion of the outer columns. In order to prevent shingling, a plurality of ribs or other protrusions are formed on the outer surface of the columns in order to create a surface more flush with the upper deck. As a result, the ribs of one pallet would prevent the protruding portion of the deck of an adjacent pallet from catching underneath the protruding portion of the deck.

These and other features of the application can be best understood from the following specification and drawings, the following of which is a brief description.

DETAILED DESCRIPTION OF THE PREFERRED EMBODIMENT

Figure 1:
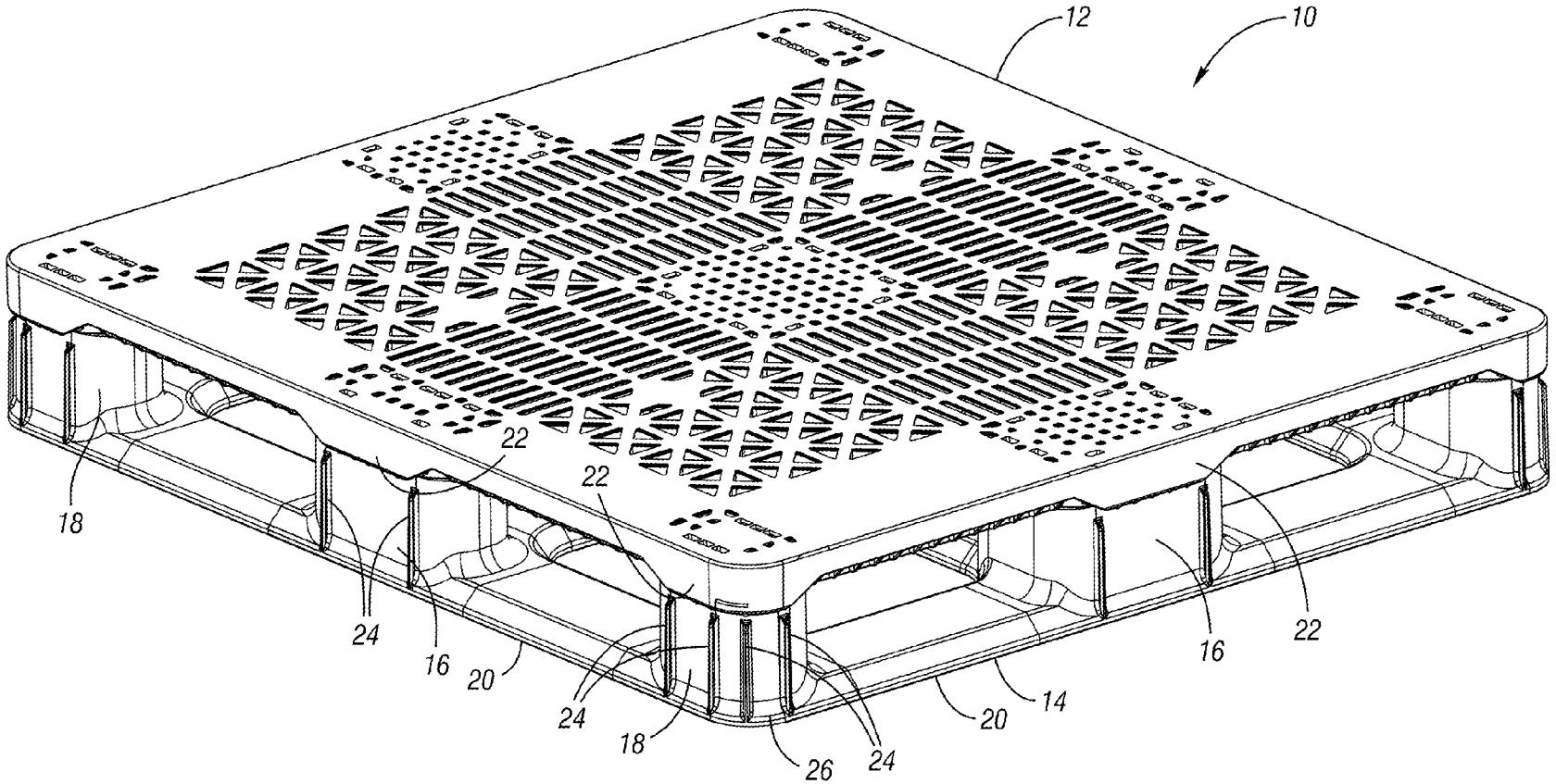
FIG. 1 is a perspective view of a pallet according to one embodiment of the present invention.

A pallet 10 according to one embodiment of the present invention is shown in FIG. 1. The pallet 10 includes an upper deck 12 and a lower portion 14, which in this embodiment includes a plurality of columns 16, 18 connected by runners 20. The columns include side columns 16 and corner columns 18. In the embodiment shown, the pallet 10 is a two-piece pallet in which the upper deck 12 is molded as an integral single piece and the lower portion 14, including columns 16, 18 and runners 20, is integrally molded as another single piece. The upper deck 12 is connected to the lower portion 14 via snap-fit connections (not shown), welding, heat staking, or other suitable connections.

The upper deck 12 includes flange portions 22, which protrude outwardly relative to outermost surfaces of the columns 16, 18 and slightly overlap the outer surfaces of the columns 16, 18. The lower portion 14 further includes a lower flange 26 about the periphery of the lower portion 14, including columns 16, 18 and runners 20. The lower flange 26 also protrudes outwardly of the outermost surfaces of the columns 16, 18.

In order to prevent shingling, the outer surfaces of the columns 16, 18 are provided with anti-shingling protrusions. In the embodiment shown, the protrusions 24 are a plurality of parallel, vertically oriented ribs 24; however, other arrangements of ribs 24 or other protrusions could be used.

Figure 2:
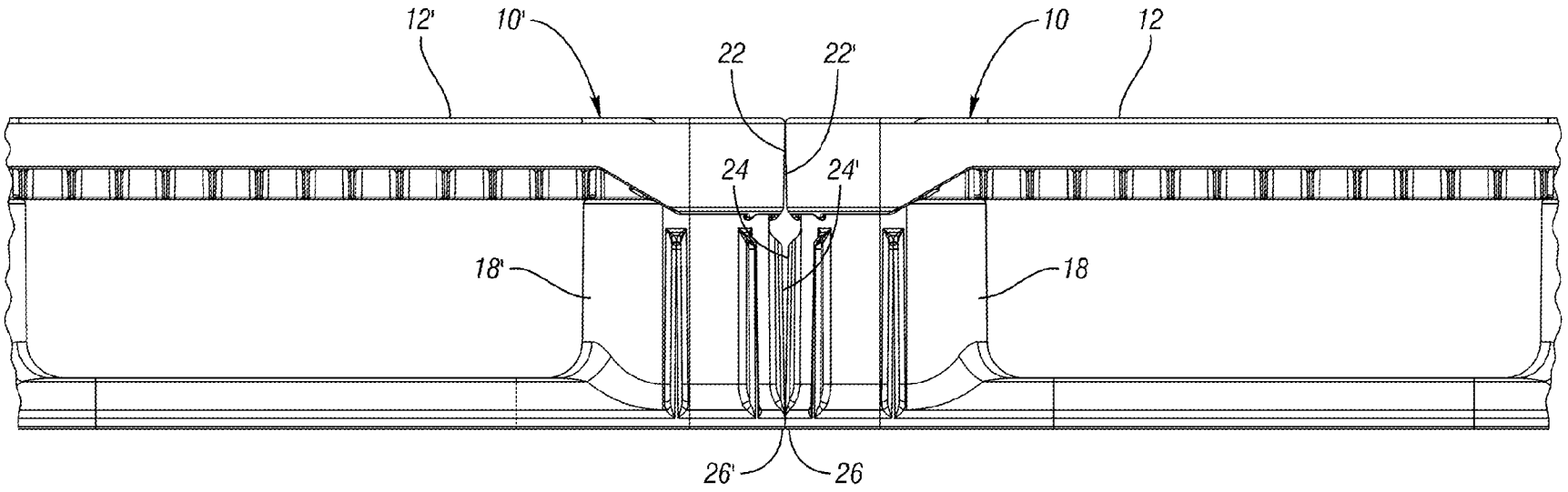
FIG. 2 is a side view of a portion of the pallet of FIG. 1 adjacent a similar pallet.

FIG. 2 illustrates the first pallet 10 adjacent a similar second pallet 10'. As shown, the flange portions 22, 22' of the two pallets 10, 10' abut one another, as do the lower flanges 26, 26'. The ribs 24, 24' may abut one another or be slightly spaced.

Figure 3:
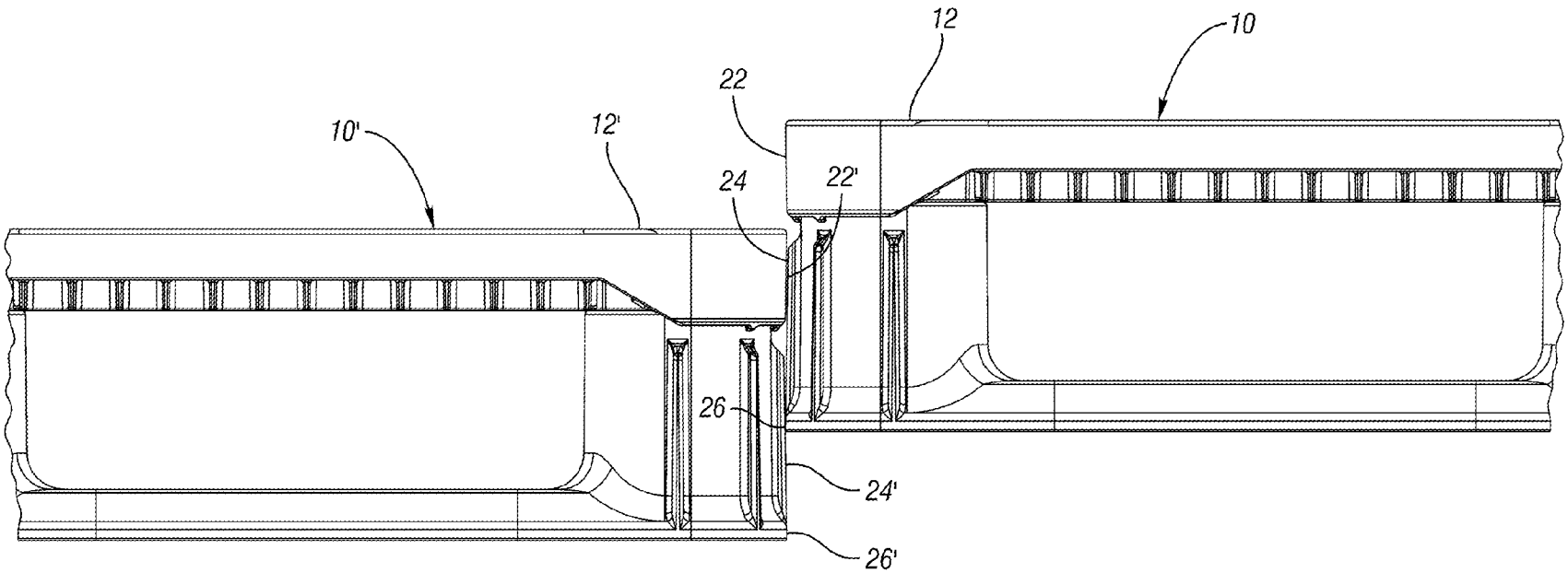
FIG. 3 illustrates how the pallet of FIG. 2 resists shingling.

Referring to FIG. 3, if the first pallet 10 is lifted (such as by a lift truck) and set next to the second pallet 10', the ribs 24 of the first pallet 10 will contact the outer flange portions 22' of the second pallet 10' and the ribs 24' of the second pallet 10' will contact the lower flange 26 of the first pallet 10, thus preventing the outer flange 22' of the second pallet 10' from getting caught underneath the outer flange portion 22 of the first pallet 10. Instead, the first pallet 10 will simply slide to the floor.

Although a pallet with runners 20 has been shown, the ribs 24 could also be provided on columns (or feet) of a nestable pallet to prevent shingling. A nestable or non-nestable pallet integrally molded as a single piece could include the anti-shingling protrusions. Other types of pallets may also benefit from the anti-shingling ribs 24 of the present invention. The present invention is not intended to be limited to the specific pallet 10 shown in FIGS. 1-3.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

a deck having an upper surface for supporting goods thereon; and a plurality of columns extending downwardly from the deck, at least a protruding portion of the deck overlapping and protruding outwardly of an outer most surface of at least one of the columns, the protruding portion extending downwardly to be a lowermost portion of the deck, at least one anti-shingling protrusion formed on the outer most surface of the at least one column below the protruding portion of the deck, wherein the at least one anti-shingling protrusion is a rib and wherein an outermost surface of the rib is substantially flush with the protruding portion of the deck.

2. The pallet of claim 1 wherein the rib is a vertically oriented rib.

3. The pallet of claim 1 wherein the rib is one of a plurality of vertically oriented ribs on the outer surface of the column.

4. The pallet of claim 3 wherein the rib includes a tapered upper end.

5. The pallet of claim 1 further including a plurality of runners connecting lower portions of the plurality of columns.

6. The pallet of claim 5 further including a lower flange protruding outwardly from the plurality of columns.

7. The pallet of claim 1 wherein the plurality of columns include corner columns and wherein the at least one column is a corner column.

8. The pallet of claim 1 wherein the at least one anti-shingling protrusion projects from the outer surface of the at least one column more than all other portions of the at least one column above the at least one anti-shingling protrusion.

9. The pallet of claim 1 wherein the at least one anti-shingling protrusion is integrally molded with the at least one column.

10. The pallet of claim 1 wherein the at least one anti-shingling protrusion is integrally molded with the at least one column.

11. A pallet comprising:

a deck having an upper surface for supporting goods thereon; and a plurality of columns extending downwardly from the deck, at least one protruding portion of the deck extending downwardly from the deck over an outer most surface of the plurality of columns and protruding outwardly of the outer most surface of the plurality of columns, a plurality of anti-shingling ribs formed on the outer most surfaces of the plurality of columns below the at least one protruding portion of the deck, wherein an outermost surface of each of the plurality of anti-shingling ribs is substantially flush with the protruding portion of the deck.

12. The pallet of claim 11 wherein the plurality of columns are side columns.

13. The pallet of claim 11 wherein the plurality of columns are corner columns.

14. The pallet of claim 11 wherein the plurality of anti-shingling ribs are a plurality of spaced-apart vertical ribs.

15. The pallet of claim 14 wherein the plurality of spaced-apart vertical ribs each have a tapered upper end tapering toward the outer most surfaces of the columns toward upper ends of the columns.

16. The pallet of claim 11 wherein the deck is molded separately from the plurality of columns.

17. The pallet of claim 16 further including a lower flange protruding outwardly from the plurality of columns.

18. The pallet of claim 11 wherein the plurality of anti-shingling ribs projects from the outer most surfaces of the plurality of columns more than all other portions of the plurality of columns above the plurality of anti-shingling ribs.

19. The pallet of claim 18 wherein an outermost surface of each of the plurality of anti-shingling ribs is substantially flush with the protruding portion of the deck, and wherein the anti-shingling ribs are integrally molded with their respective columns.

* * * * *